US007320741B2

(12) United States Patent
Tolan et al.

(10) Patent No.: US 7,320,741 B2
(45) **Date of Patent: *Jan. 22, 2008**

(54) METHOD OF XYLANASE TREATMENT IN A CHLORINE DIOXIDE BLEACHING SEQUENCE

(75) Inventors: Jeffrey S. Tolan, Ottawa (CA); Corina Popovici, Ottawa (CA); Luc Thibault, Casselman (CA)

(73) Assignee: Iogen Bio-Products Corporation, Ontario (CA)

( * ) Notice: Subject to any disclaimer, the term of this patent is extended or adjusted under 35 U.S.C. 154(b) by 193 days.

This patent is subject to a terminal disclaimer.

(21) Appl. No.: 10/466,640

(22) PCT Filed: Jan. 18, 2002

(86) PCT No.: PCT/CA02/00065

§ 371 (c)(1),
(2), (4) Date: Nov. 12, 2003

(87) PCT Pub. No.: WO02/057541

PCT Pub. Date: Jul. 25, 2002

(65) Prior Publication Data

US 2004/0077071 A1 Apr. 22, 2004

Related U.S. Application Data

(60) Provisional application No. 60/262,858, filed on Jan. 18, 2001.

(51) Int. Cl.
*D21C 3/18* (2006.01)

(52) U.S. Cl. ..... 162/73; 162/74; 162/78; 8/101; 8/107; 8/115; 8/51; 435/278

(58) Field of Classification Search ..... 162/65, 162/87, 88, 89, 72, 76, 73, 78; 435/277, 435/278; 8/101, 107, 115.51, 116.1
See application file for complete search history.

(56) References Cited

U.S. PATENT DOCUMENTS

| | | | | |
|---|---|---|---|---|
| 5,369,024 | A | 11/1994 | Jeffries et al. | |
| 5,405,769 | A | 4/1995 | Campbell et al. | |
| 5,405,789 | A | 4/1995 | Dekker et al. | |
| 5,618,386 | A * | 4/1997 | Arbeloa et al. | 162/72 |
| 5,645,686 | A * | 7/1997 | Troughton et al. | 162/65 |
| 5,759,840 | A | 6/1998 | Sung et al. | |
| 5,916,795 | A | 6/1999 | Fukunaga et al. | |
| 5,935,836 | A | 8/1999 | Vehmaanperä et al. | |
| 2003/0166236 | A1 | 9/2003 | Sung | |
| 2005/0150619 | A1 * | 7/2005 | Tolan et al. | 162/72 |

FOREIGN PATENT DOCUMENTS

| | | | |
|---|---|---|---|
| EP | 0 383 999 | A2 | 8/1990 |
| EP | 0 386 888 | A2 | 9/1990 |
| GB | 2 248 075 | A | 3/1992 |
| WO | WO 89/08738 | | 9/1989 |
| WO | WO 91/02840 | | 3/1991 |
| WO | WO 91/05908 | | 5/1991 |
| WO | WO 91/11533 | * | 8/1991 |
| WO | WO 91/11553 | | 8/1991 |
| WO | WO 92/07998 | | 5/1992 |
| WO | WO 9207998 | A1 * | 5/1992 |
| WO | WO 92/21813 | | 12/1992 |
| WO | WO/97/36995 | | 10/1997 |
| WO | WO 01/92487 | A2 | 12/2001 |

OTHER PUBLICATIONS

Douglas C. Pryke, "Chlorine Dioxide Delignification", 1994 Bleach Plant Operations Short Course, Course Notes, 1994, pp. 3-3-1 and 3-3-28.*

Bermek, Hakan, Li Kaichang, and Eriksson, Karl-Erik L., "Pulp Bleaching with Manganese Peroxide and Xylanase: A Synergistic Effect," *Tappi Journal,* pp. 1-10, 2000.

Eriksson, K.-E. L., "Biotechnology in the pulp and paper industry," *Wood Science and Technology,* 24:79 -101, 1990.

Luthi, Ernst, Jasmat, Nila Bhana, and Bergquist, Peter L., "Xylanase from the Extremely Thermophilic Bacterium "*Caldocellum saccharolyticum*": Overexpression of the Gene in *Escherichia coli* and Characterization of the Gene Product," *Applied and Environmental Microbiology*, vol. 56, No. 9, pp. 2677-2683, 1990.

Paice, M.G., Bernier, R., Jr., and Jurasek, L., "Viscosity-Enhancing Bleaching of Hardwood Kraft Pulp with Xylanase from a Cloned Gene," *Biotechnology and Bioengineering*, vol. 32, pp. 235-239, 1998.

Pommier, Jean-Claude, Fuentes, Jean-Luc, and Goma, Gerard, "Using enzymes to improve the process and the product quality in the recycled paper industry," *Tappi Journal*, pp. 187-191, 1989.

Shah, A.K., Cooper, D., Adolphson, R., and Eriksson, K.-E. L., "Xylanase Treatment of Oxygen-Bleached Hardwood Kraft Pulp at High Temperature and Alkaline pH Levels Gives Substantial Savings in Bleaching Chemicals," *Journal of Pulp and Paper Science,* vol. 26, No. 1, pp. 8-11, 2000.

Simpson, Helen D., Haufler, Ursula R., and Daniel Roy M., "An extremely thermostable xylanase from the thermophilic eubacterium *Thermotoga, " Biochem, J.,* vol. 277, pp. 413-417, 1991.

Winterhalter, Christoph and Liebl, Wolfgang, "Two Extremely Thermostable Xylanases of the Hyperthermophilic Bacterium *Thermotoga maritime* MSB8," *Applied and Environmental Microbiology,* vol. 61, No. 5, pp. 1810-1815, 1995.

Wong, K.K.Y., James, C.S. and Campion, S.H., "Xylanase Pre- and Post-Treatments of Bleached Pulps Decrease Absorption Coefficient," *Journal of Pulp and Paper Science,* vol. 26, No. 10, pp. 377-388, 2000.

(Continued)

*Primary Examiner*—Mark Halpern
(74) *Attorney, Agent, or Firm*—Fitzpatrick, Cella, Harper & Scinto

(57) ABSTRACT

A method of bleaching chemical pulp with xylanase after chemical bleaching is provided. The method comprises the steps of exposing chemical pulp to a chlorine dioxide bleaching stage to produce a partially bleached pulp, treating the partially bleached pulp with a xylanase in an enzyme treatment stage at a pH of about 3 to about 8, then carrying out an alkaline extraction of the pulp. The pulp bleaching method of the present invention may be performed in a pulp mill as part of a complex pulp bleaching process.

3 Claims, 4 Drawing Sheets

OTHER PUBLICATIONS

Company Brochure, "Chlorine Dioxide Generation," Paprican Mtl., pp. 2-5, 1993.
International Search Report, dated Dec. 27, 2002, for corresponding International Application No. PCT/CA02/00065.
International Preliminary Examination Report, dated Feb. 27, 2003, for corresponding International Appilcation No. PCT/CA02/00065.
Chlorine Dioxide Generation, published by Paprican, Pointe Claire, Quebec (1993).
Lever, M., "A New Reaction for Colorimetric Determination of Carbohydrates," *Analytical Biochemistry,* vol. 47 (1972), pp. 273-279.
PAPTAC Bleaching Committee, Glossary of Bleaching Terms (1996).
PAPTAC-Standard Testing Methods, "Standard E.1: Brightness of Pulp, Paper and Paperboard" (1990).
TAPPI Test Method T 210, "Sampling and Testing Wood Pulp Shipments for Moisture" (1993).
TAPPI Test Method T236 cv-85, "Kappa number of pulp" (1993).
International Search Report, dated May 19, 2003, for International Application No. PCT/CA03/00300.
International Preliminary Examination Report, dated Apr. 22, 2004, for International Application No. PCT/CA03/00300.

* cited by examiner

Figure 1A. Pulp Bleaching Sequences

B=any chemical bleaching stage $X_1$-B-$X_2$-E-D-E-D $X_1$-B-$X_2$-E-B-E-B

O-$X_1$-B-$X_2$-E-D-E-D

Figure 1B. Pulp Bleaching Sequences

Do=chlorine dioxide bleaching stage

Do-X-E-D-E-D

O-Do-X-E-D-E

O-Do-X-E-D-E-D

O-Do-X-E-D-X-E-D

METHOD OF XYLANASE TREATMENT IN A CHLORINE DIOXIDE BLEACHING SEQUENCE

This application is the U.S. National phase of PCT International Application No. PCT/CA02/00065, filed Jan. 18, 2002, which claims the benefit of U.S. Provisional Application No. 60/262,858, filed Jan. 18, 2001.

The invention relates to methods of bleaching pulp. More specifically the invention relates to methods of bleaching pulp using xylanase.

BACKGROUND OF THE INVENTION

The production of bleached chemical pulp is a major industry around the world. More than 50 million tons of bleached pulp is produced annually. Bleached chemical pulp is the largest component of all types of white paper, including that used in photocopy paper, writing paper, and paper packaging. In addition, bleached chemical pulp is also used to impart strength to less expensive grades of paper, such as newsprint. Bleached chemical pulp has large markets because of its high degree of whiteness and cleanliness, the stability of the whiteness, its high strength, and the ease and uniformity of the printing surface it provides. These attributes are obtained when lignin, which is colored and decreases the interfiber bonding of the cellulose, is almost completely removed from the pulp.

In the process of chemical pulping, the furnish (or feedstock) primarily consists of wood chips which are added to a reaction chamber, known as a digester, and are treated with chemicals to dissolve lignin in the pulp. There are several chemical pulping processes known in the art. Two of the major chemical pulping processes are kraft pulping, in which the pulp is cooked in alkaline liquor, and sulfite pulping, in which the pulp is cooked in acidic liquor. Both kraft pulping and sulfite pulping may be performed in batch or continuous digesters.

One of the main purposes of the pulping process is to release lignin which binds cellulose fibers in the feedstock. Pulping dissolves 85% to 95% of the lignin in the feedstock material. Following the pulping stage, the pulp is washed with water to remove dissolved lignin.

While pulping removes most of the lignin in the feedstock material, it is not capable of removing all the lignin without destroying the cellulose fibers of the feedstock. The remaining lignin is removed from the pulp by bleaching.

A pulp bleaching process may consist of many stages. For example, following pulping, a pulp bleaching process may comprise an alkaline oxygen delignification stage (O), an enzymatic treatment stage (X), one or more chlorine dioxide stages (D), and one or more alkaline extraction stages (E). A pulp bleaching process may also comprise one or more water washes or alternatively, each stage may comprise a water wash as a final step of the stage. Thus, a representative pulp bleaching sequence in which pulp is bleached using three chlorine dioxide stages and two alkaline extraction stages may be represented as D-E-D-E-D. Similarly, a pulp bleaching sequence wherein pulp is subjected to an alkaline oxygen delignification stage, an enzymatic treatment stage, three chlorine dioxide bleaching stages and two alkaline extraction stages wherein each stage is followed by a water wash may be represented by O-X-D-E-D-E-D.

It is common for mills to perform an alkali-oxygen delignification stage prior to carrying out chemical bleaching of pulp. This process consists of reacting the pulp with oxygen and alkali at high temperatures (approximately 100° C.) for a period of about one hour. Alkali-oxygen delignification reduces the amount of lignin in the pulp by 35-50%, but this process is harsh on the pulp and is often accompanied by destruction of some of the cellulose fibers in the pulp. Following alkali-oxygen delignification, the pulp is washed as described earlier to remove solubilized lignin.

The next bleaching stage after alkali-oxygen delignification is usually chemical bleaching with oxidative chemicals, the most prominent being chlorine dioxide ($ClO_2$). However, several processes have been described which may facilitate or enhance bleaching of pulp prior to chemical bleaching. For example, an enzymatic treatment stage with xylanase may be used to enhance the bleaching of pulp prior to chemical bleaching.

Xylanases are used in the pulp and paper industry to enhance the bleaching of pulp and to decrease the amount of chlorinated chemicals used in bleaching stages (Erickson, 1990; Paice et al., 1988; Pommier et al., 1989). There have been several mechanisms proposed for the bleaching action of xylanase. One is that lignin is connected to crystalline cellulose through xylan and xylanase enzymes facilitate bleaching of pulp by hydrolysing xylan, releasing coloured lignin from the pulp. A second proposed mechanism is that xylanase removes xylan thereby improving the alkali extractability of the pulp. Regardless of the mechanism, xylanase treatment allows subsequent bleaching chemicals such as chlorine, chlorine dioxide, hydrogen peroxide, or combinations of these chemicals to bleach pulp more efficiently than in the absence of xylanase. Pretreatment of pulp with xylanase prior to chemical bleaching increases the whiteness and quality of the final paper product and reduces the amount of chlorine-based chemicals which must be used to bleach the pulp. This in turn decreases the chlorinated effluent produced by such processes.

Xylanases have been isolated from a variety of organisms including bacteria and fungi. Generally, fungal xylanases exhibit optimal activity at acidic pHs, in the range of about 3.5 to 5.5, and a temperature of about 50° C. In contrast, bacterial xylanases exhibit optimal activity at pH 5 to pH 7 and a temperature optimum between 50° C. and 70° C. However, there are other xylanase enzymes which exhibit optimal activity under other conditions. For example, U.S. Pat. No. 5,405,789 to Campbell et al., discloses construction of thermostable mutants of low molecular mass xylanase from *Bacillus circulans*. U.S. Pat. No. 5,759,840 to Sung et al., discloses modification of a family 11 xylanase from *Trichoderma reesei* to improve thermophilicity, alkalophilicity and thermostability as compared to the natural xylanase. U.S. Pat. No. 5,916,795 to Fukunaga et al., discloses a thermostable xylanase from *Bacillus*. A publication entitled "Xylanase Treatment of Oxygen-Bleached Hardwood Kraft Pulp at High Temperature and Alkaline pH Levels Gives substantial Savings in Bleaching Chemicals" to Shah et al., (J. of Pulp and Paper Science, vol 26 No. 1 January 2000, which is herein incorporated by reference) discloses treating oxygen delignified hardwood pulp with xylanase from *Thermotoga maritima* at pH 10 and 90° C. and subsequently bleaching the pulp. These documents disclose using xylanases to enzymatically treat pulp prior to chemical bleaching. However, none of these documents suggest using xylanases to treat pulp after a chemical bleaching stage.

The next stage in a typical pulp bleaching process is usually chlorine dioxide bleaching with chlorine dioxide, chlorine or in some instances, a combination of chlorine dioxide and other oxidative bleaching agents. For example, the first chlorine dioxide stage in a chemical bleaching process is often called the $D_o$ or D100 stage. Subsequent chlorine dioxide bleaching stages are referred to as $D_1$, $D_2$ and so on. For mills that bleach pulp without an alkali-oxygen delignification stage, the $D_o$ stage is the first chemical bleaching stage. The $D_o$ stage is usually carried out at pH 1.5 to 3.0. In a small but decreasing number of mills, up to 30% to 50% chlorine gas may be added to $ClO_2$ in an effort to achieve a higher efficiency of lignin removal. Such a stage is referred to as a $C_D$ stage. After a $D_o$ or $C_D$ stage, the pulp is washed with water, and alkaline extracted. Alkaline extraction is carried out by adjusting the pH of the pulp to 9.0 to 12.0 with sodium hydroxide or sodium carbonate at a temperature between 60° C. to 120° C. for a period of 30 to 90 minutes. After the alkaline extraction stage, the pulp is washed with water. The chlorine dioxide bleaching stage, wash and alkaline extraction is repeated until the pulp is suitably bleached. In most cases, two to three rounds of bleaching, alternating between chlorine dioxide stages and alkaline extraction stages, is required before the pulp is suitably bleached.

In all present commercial applications, xylanase use comprises a xylanase treatment stage prior to the first chlorine dioxide stage. This results in a pulp with increased brightness compared to pulp treated in a similar manner but without xylanase treatment. Alternatively, a specific brightness level can be achieved using a smaller amount of bleaching chemicals when the pulp is treated with xylanase prior to bleaching, compared to pulp that is not treated with xylanase before bleaching.

U.S. Pat. No. 5,645,686 discloses a process for bleaching a chemical paper pulp by means of a sequence of treatment stages involving at least one stage with hydrogen peroxide and at least one stage with a peroxyacid. The patent also discloses a xylanase treatment stage in combination with the bleaching sequence comprising peroxyacid. The patent does not suggest treating pulp with a xylanase treatment stage after a chlorine dioxide stage in a pulp bleaching process which employs only chlorine dioxide bleaching stages. Further, there is no teaching as to whether a xylanase treatment stage after a first chlorine dioxide bleaching stage may be more effective in enhancing the bleaching of pulp compared to a pulp bleaching sequence wherein xylanase treatment is performed prior to the first chlorine dioxide bleaching stage.

WO 91/05908 discloses a process for producing bleached lignocellulosic pulp having reduced organically bound chlorine and reduced brightness reversion. The process entails treating pulp with xylanase after a chemical bleaching stage which primarily employs chlorine. The reference teaches that xylanase treatment after a chlorine bleaching stage is not as effective at bleaching pulp as xylanase treatment prior to a chlorine bleaching stage. The reference does not address whether a chlorine dioxide bleaching stage, as employed now by most mills, followed by a xylanase treatment stage may be capable of enhancing the bleaching of pulp.

A publication entitled "Xylanase Pre- and Post-treatments of Bleached Pulps Decrease Absorption Coefficient" by Wong et al., (2000. J. of Pulp and Paper Science Vol 26 No. 10 377-383, which is herein incorporated by reference) teaches xylanase treatment of pulp as a final stage of a partial or complete chemical bleaching process. However, the reference teaches that xylanase treatment of pulp after chemical bleaching increases the brightness of pulp by a smaller amount than does conventional xylanase treatment of pulp before chemical bleaching.

In WO 91/11553, there is disclosed a method of pulp bleaching comprising treating the pulp with an enzyme in two or more steps of the bleaching process. When enzyme is used after a bleaching stage, the pulp is subjected to alkali extraction prior to adding enzyme.

While the xylanase treatments in pulp bleaching processes generally result in enhanced pulp bleaching, compared to equivalent pulp bleaching processes that do not comprise xylanase treatment, there is a need in the art to increase the efficiency of the xylanase treatment. The pulp industry is under pressure to decrease the use of chlorine-containing bleaching chemicals, such as chlorine and chlorine dioxide, and thus, any method or process which can be integrated into a pulp bleaching process to reduce the use of chlorine-containing bleaching chemicals or the toxic effluents produced by the use of such chemicals would be an important and valuable asset to the pulp industry. The industry would also save money by using less chemicals, such as chlorine dioxide in bleaching stages, and sodium hydroxide and hydrogen peroxide in alkaline extraction stages. Improving the efficiency of xylanase treatment would address these concerns by further decreasing chemical usage.

There is a need in the art for novel methods and more efficient methods of bleaching pulp. Further, there is a need in the art for methods, or processes which can be integrated into existing pulp bleaching processes to increase the efficiency of the bleaching process and reduce the use of chlorine containing bleaching compounds or the toxic effluents produced by the use of such chemicals. There is also a need to save money by decreasing chemical usage.

It is an object of the invention to overcome drawbacks in the prior art.

The above object is met by a combination of the features of the main claims. The sub claims disclose further advantageous embodiments of the invention.

SUMMARY OF THE INVENTION

The invention relates to methods of bleaching pulp. More specifically the invention relates to methods of bleaching pulp using xylanase.

According to an aspect of the present invention there is provided a method of bleaching chemical pulp comprising the steps of:

a) treating chemical pulp with a first xylanase in a first enzyme treatment stage to produce an enzyme treated pulp;

b) exposing the enzyme treated pulp to a chemical bleaching stage to produce a partially bleached pulp; and c) retreating the partially bleached pulp with a second xylanase in a second enzyme treatment stage at a pH of about 3 to about 8, preferably about 5 to about 8.

The pulp bleaching method may be performed in a mill as part of a larger pulp bleaching process, and the chemical pulp may comprise kraft pulp, soda pulp or sulfite pulp.

Also according to the method of the present invention as defined above, the chemical bleaching stage (step b)) may employ any bleaching process known in the art but preferably comprises a bleaching agent selected from the group consisting of chlorine dioxide, chlorine, ozone or a combination thereof. Alternatively, the chemical bleaching stage (step b)) may comprise a bleaching agent selected from the group consisting of percarboxylic acid, peroxysulfuric acid and hypochlorous acid. The percarboxylic acid may be peracetic acid.

Also according to the method of the present invention as defined above, the first step of treating the chemical pulp with a first xylanase in a first enzyme treatment stage (step a)) may be preceded by an alkaline oxygen delignification stage.

Further, according to the present invention as defined above, the first xylanase may be different from the second xylanase or the first xylanase may be identical to the second xylanase. The first xylanase or the second xylanase may be selected from the group consisting of:

BIOBRITE EB (wild-type xylanase II with the following mutations: 10H, 27M, 29L, 75A, 105H, 125A and 129E), wild-type *Trichoderma reesei* xylanase II;

TrX-HML-GHAE,

TrX-HML-ARAE,

TrX-HML-GRAE,

TrX-HML-GPHAE, and

TrX-HML-GPRAE.

Further, the conditions of the first enzyme treatment stage may be different from the conditions of the second enzyme treatment stage or the conditions of the first enzyme treatment stage may be identical to conditions in the second enzyme treatment stage.

Also according to the method of the present invention as defined above, the method may be preceded by one or more oxygen delignification stages, water washes, or a combination thereof. Thus, the pulp bleaching method of the present invention may form part of a more elaborate or complex pulp bleaching process.

The chemical pulp may comprise kraft pulp, soda pulp or sulfite pulp and the method may be performed in a pulp mill as part of a larger bleaching process.

In another embodiment of the present invention, there is provided a method of bleaching chemical pulp in the absence of a peroxyacid, the method comprising the steps of:

a) exposing the chemical pulp to a first chlorine dioxide bleaching stage to produce a partially bleached pulp;

b) treating the partially bleached pulp with a xylanase in an enzyme treatment stage at an initial pH in the range of about 3 to less than 8 to produce an enzymatically treated pulp;

c) extracting the enzymatically treated pulp in an alkaline extraction stage to produce an extracted pulp, and;

d) re-exposing the extracted pulp to a second chlorine dioxide bleaching stage.

The present invention also provides a pulp bleaching process, wherein the process comprises a sequence of stages selected from the group consisting of:

$X_1BX_2EDED$;

$X_1BX_2EBEB$; and $OX_1BX_2EDED$, and wherein:

$X_1$ represents treating chemical pulp with a first xylanase in a first enzyme treatment stage;

$X_2$ represents treating partially bleached pulp with second xylanase in a second enzyme treatment stage;

B represents any chemical bleaching stage;

D represents a chlorine dioxide bleaching stage;

O represents an alkaline oxygen delignification stage; and

E represents an alkaline extraction stage.

The present invention also pertains to a pulp bleaching process wherein the process comprises a sequence selected from the group consisting of:

DoXEDED;

ODoXEDE;

ODoXEDED; and

ODoXEDXED, and wherein:

X represents treating chemical pulp with a xylanase enzyme;

D and Do represents a chlorine dioxide bleaching stage;

O represents an alkaline oxygen delignification stage; and

E represents an alkaline extraction stage.

The pulp bleaching method of the present invention enhances pulp bleaching compared to conventional pulp bleaching processes known in the art. Further, the pulp bleaching method of the present invention is more easily integrated into pulp bleaching processes that are currently practised in the art. Specifically, the pulp bleaching method of the present invention does not require a peroxyacid bleaching stage, a treatment stage comprising hydrogen peroxide in an alkaline medium or a metal ion sequestering stage.

The chlorine dioxide bleaching stages may comprise chlorine dioxide or chlorine dioxide and at least one other bleaching agent selected from the group consisting of chlorine, ozone or a combination thereof, but such that chlorine dioxide is the most abundant bleaching agent in the chlorine dioxide bleaching stage. Chlorine dioxide bleaching may be performed at a pH between about 1 and about 5, but preferably about 1.5 to about 3.

This summary does not necessarily describe all necessary features of the invention but that the invention may also reside in a sub-combination of the described features.

BRIEF DESCRIPTION OF THE DRAWINGS

These and other features of the invention will become more apparent from the following description in which reference is made to the appended drawings wherein:

FIG. 1 shows several representative pulp bleaching sequences contemplated by the pulp bleaching method of the present invention involving any bleaching stage (B). FIG. 1A shows several bleaching sequences. FIG. 1B shows other representative pulp bleaching sequences involving a chlorine dioxide bleaching stage.

DESCRIPTION OF PREFERRED EMBODIMENT

Figure 2:
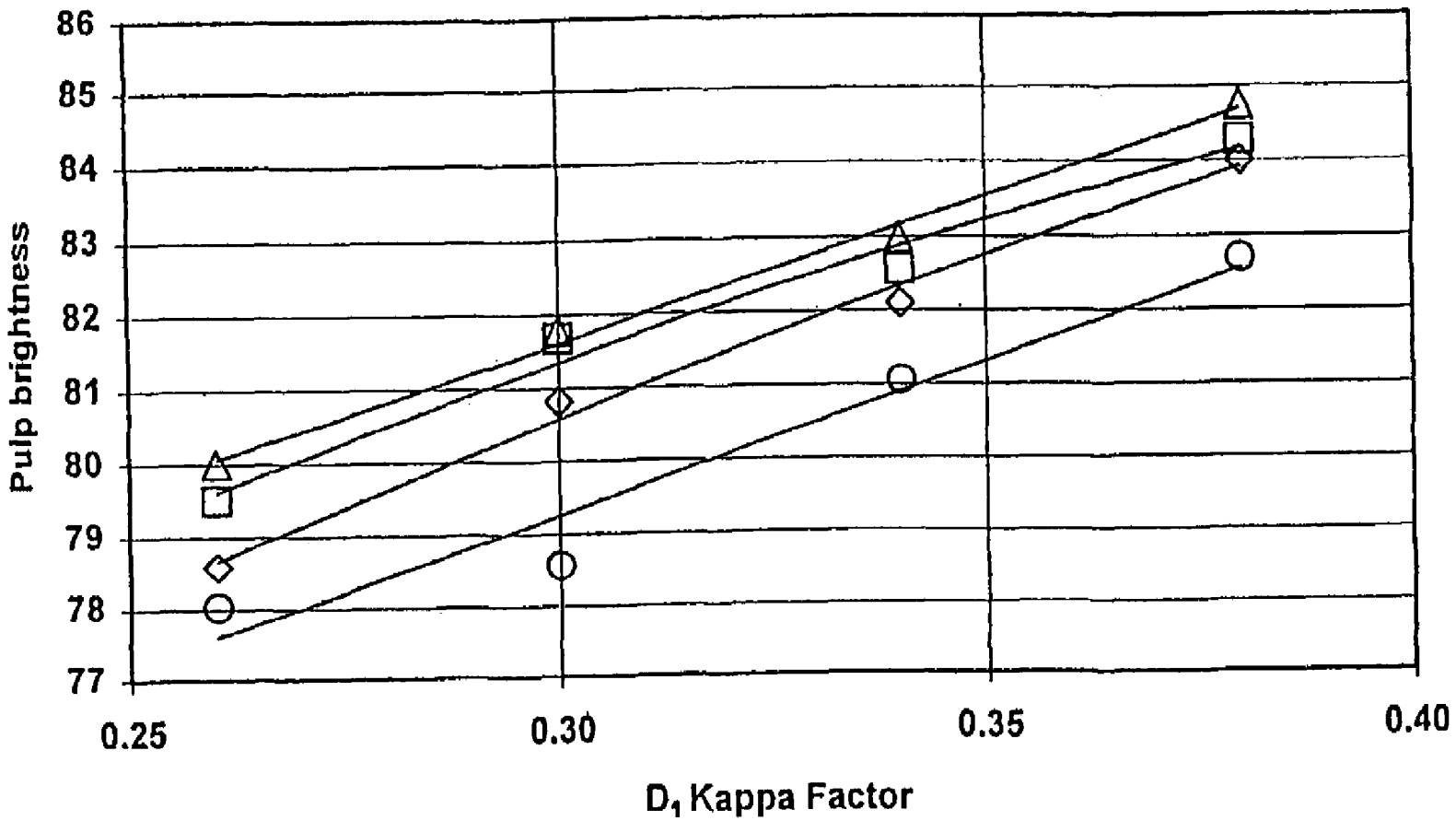
FIG. 2 shows the effect of 3 types of xylanase treatment on hardwood pulp brightness relative to a control pulp not treated with xylanase ($DoEoD_1$; ○). Xylanase treatment prior to chemical bleaching ($XDoEoD_1$; ◇); xylanase treatment after chemical bleaching ($DoXEoD_1$; □) and xylanase treatment prior to and after chemical bleaching ($X_1DoX_2EoD_1$; Δ).

The invention relates to methods of bleaching pulp. More specifically the invention relates to methods of bleaching pulp using xylanase.

The following description is of a preferred embodiment by way of example only and without limitation to the combination of features necessary for carrying the invention into effect.

According to the present invention, there is provided a method of bleaching chemical pulp with xylanase. In an aspect of an embodiment of the present invention, there is provided a method of bleaching chemical pulp comprising the steps of:

a) treating the chemical pulp with a first xylanase in a first enzyme treatment stage to produce an enzyme treated pulp, b) exposing the enzyme treated pulp to a chemical bleaching stage to produce a partially bleached pulp; and c) treating the partially bleached pulp with a second xylanase in a second enzyme treatment stage at a pH of about 3 to about 8, preferably about 5 to about 8.

It is preferred that the chemical bleaching stage comprises a water wash as a final step of the stage prior to the step of treating the partially bleached pulp with a second xylanase. More preferably, the first enzyme treatment stage, chemical bleaching stage and second enzyme treatment stage comprise a water wash as a final step of each stage. The second xylanase treatment stage may also be followed by an alkali extraction stage. Further, the pulp bleaching method of the present invention may be performed in a mill as part of a complex pulp bleaching process.

By the term "chemical pulp" it is meant any type of virgin fiber, secondary fiber, woody or nonwoody fiber, softwood, hardwood or a mixture thereof which has been treated by chemical pulping such as, but not limited to, kraft pulp, soda pulp or sulfite pulp and is subsequently in a form suitable for bleaching. Preferably, the chemical pulp comprises virgin fiber. Chemical pulp also includes kraft pulp, soda pulp or sulfite pulp which has been exposed to an alkali oxygen delignification stage prior to practising the method of the present invention. Other conditions associated with the production of chemical pulp, including kraft and sulfite pulps are described in Pulp Bleaching: Principles and Practice (edited by Dence and Reeve, 1996; which is herein incorporated by reference).

By the term "chemical bleaching stage" it is meant treating pulp with at least one chemical under conditions which promote bleaching of pulp. A chemical bleaching stage may comprise any pulp bleaching stage known in the art, including acidic bleaching stages, alkaline bleaching stages and pH neutral bleaching stages over a pH between about 1 to about 14. The bleaching agent of an acidic bleaching stage may comprise chlorine dioxide or chlorine dioxide in combination with chlorine, ozone or both chlorine and ozone. Alternatively, the bleaching agent may comprise peroxysulfuric acid, hypochlorous acid, percarboxylic acids, such as, but not limited to peracetic acid, or hydrogen peroxide in combination with an activator such as, but not limited to nitrilamine (cyanamide). Other activators and bleaching agents which may be used in the method of the present invention are described in Dence and Reeve (1996, Pulp Bleaching: Principles and Practice, Dence and Reeve, eds., which is herein incorporated by reference).

In a preferred embodiment, the chemical bleaching stage is a chlorine dioxide bleaching stage performed at a pH in the range of about 1 to about 5, preferably about 1.5 to about 3. These conditions are similar to the chlorine dioxide bleaching stage in a pulp mill, as would be known to one of skill in the art. In embodiments of the method of the present invention which employ multiple chemical bleaching stages, these stages may be identical or the stages may be dissimilar. Furthermore, a pulp bleaching process consisting of multiple acidic or alkaline bleaching stages may employ different bleaching agents in different amounts or under different conditions from other acidic or alkaline bleaching stages in the same pulp bleaching process.

Any xylanase which is capable of hydrolyzing xylan and enhancing the bleaching of pulp may be used in the first enzyme treatment stage of the method of the present invention. Further, any xylanase which is capable of hydrolyzing the xylan and enhancing the bleaching of pulp under the pH conditions of the second enzyme treatment stage may be used in the second enzyme treatment stage. The amount of lignin associated with pulp may be estimated by determining the kappa number of the pulp, which may be performed according to Example 1. A method, process or step which reduces the kappa number of the pulp by a greater amount than another method, process, or step may be considered to be more effective in removing lignin associated with pulp and thus, is more effective in enhancing the bleaching of pulp. The brightness of the pulp may be determined according to Example 7. A method, process or step which produces a pulp with a higher ISO brightness number than another method, process or step is more effective in enhancing the bleaching of pulp.

Both wild-type and genetically modified xylanases may be employed in the method of the present invention. For example, but not wishing to be limiting, xylanases which may be useful in the method of the present invention include fungal xylanases which exhibit optimal activity at acidic pHs in the range of about 3.5 to about 5.5 and at temperatures of about 50° C., and bacterial xylanases which exhibit optimal activity at pH 5 to 7 and temperatures between about 50° C. and 70° C. Also, the present invention contemplates using other xylanase enzymes under other conditions such as, but not limited to wild-type, thermostable and alkalostable xylanases as taught in U.S. Pat. No. 5,405,789 which discloses mutants of low molecular mass from *Bacillus circulans*, and U.S. Ser. No. 60/213,803 to Sung (which is herein incorporated by reference), which discloses xylanases having increased thermophilicity and alkalophilicity relative to the wild-type *Trichoderma* xylanase, or wild-type thermophilic enzyme. Further, other xylanases which may be useful in the method of the present invention include thermostable xylanases such as *Caldocellum saccharolyticum, Thermotoga maritima* and *Thermotoga* sp. Strain FJSS-B.1 (Lüithi et al. 1990; Winterhalter et al. 1995; Simpson et al. 1991; which are herein incorporated by reference). The method of the present invention further contemplates the use of xylanases derived from, but not limited to *Trichoderma reesei* xylanase I, *Trichoderma viride* xylanase, *Streptomyces lividans* xylanase B, *Streptomyces lividans* xylanase C, or other non-family 11 xylanases, for example, but not wishing to be limiting, *Caldocellum saccharolyticum, Thermotoga maritima* and *Thermotoga* sp. Strain FJSS-B.1._Genetically modified variants of these xylanases also may be used in combination or alone in the enzyme treatment stages of the present invention provided they are capable of enhancing the bleaching of pulp, that is enhancing removal of lignin from pulp under the conditions of the first enzyme treatment stage, second enzyme treatment stage or both, and after the enzyme treatment stage or stages are followed by one or more bleaching or extraction stages.

As is evident to someone of skill in the art, some native xylanases exhibit both xylanase and cellulase activities. The additional cellulolytic activity is undesirable for pulp bleaching due to its detrimental effect on cellulose, the bulk material in paper. It is preferred that the method of the present invention use one or more xylanases which lacks cellulolytic activity or is reduced in cellulolytic activity. Preferably, the method of the present invention uses one or more xylanases which have reduced or impaired cellulase activity.

The first xylanase employed in the first enzyme treatment stage may be identical to the second xylanase used in the second enzyme treatment stage, or the first xylanase may be different from the second xylanase. Further, the conditions of the first enzyme treatment stage may be identical or dissimilar to the conditions in the second enzyme treatment stage. Conditions of the enzyme treatment stage include, but are not limited to temperature, pH, incubation time, amount of xylanase used, components of the incubation medium, and pulp consistency. As would be evident to someone of skill in the art, it is preferred that the conditions of an enzyme treatment stage are compatible with the xylanase enzyme or enzymes used in that enzyme treatment stage. Specifically, the conditions of each enzyme treatment stage should allow the xylanase used in the enzyme treatment stage to exhibit more than about 10% of its maximum activity, and more preferably greater than about 30% of its maximum activity under the conditions of the enzyme treatment stage. Thus, it may be possible that an extremely alkalophilic xylanase used in the first enzyme treatment stage may exhibit less than 10% of its maximum activity under the conditions of the second enzyme treatment stage, that is under pH conditions between 3 and less than 8. It is preferred that such an alkalophilic xylanase is not used in the second enzyme treatment stage. The activity of a xylanase may be determined by any method known in the art, for example, but not limited to the assays described in Example 2.

Without wishing to be limiting, the first xylanase, second xylanase or both xylanases may comprise wild-type *Trichoderma reesei* xylanase, or a genetically modified variant thereof such as, but not limited to: BIOBRITE EB xylanase (commercially available from logen Corporation, Canada);

TrX-HML-AHAE,
TrX-HML-GHAE,
TrX-HML-ARAE,
TrX-HML-GRAE,
TrX-HML-GPHAE,
TrX-HML-GPRAE (disclosed in WO 01/92487; which is incorporated herein by reference), or other modified xylanases disclosed in WO 01/92487 that exhibits properties of xylanase as defined above.

Referring now to FIG. 1A, there is shown various pulp bleaching sequences which are contemplated by the method of the present invention. The pulp bleaching sequences are for illustrative purposes only and are not meant to limit the invention in any manner. The present invention contemplates pulp bleaching sequences comprising a xylanase treatment stage prior to a chemical bleaching stage and again following a chemical bleaching stage ($X_1$-B-$X_2$) such as, but not limited to:

$X_1$-B-$X_2$,
$X_1$-B-$X_2$-B,
O-$X_1$-B-$X_2$,
$X_1$-B-$X_2$-E-D-E-D,
O-$X_1$-B-$X_2$-E-D-E-D,
$X_1$-B-E-$X_2$,
$X_1$-B-E-$X_2$-D-E,
O-$X_1$-B-E-$X_2$ and
$X_1$-B-$X_2$-E-B-E-B wherein $X_1$ represents treating chemical pulp with a first xylanase in a first enzyme treatment stage, $X_2$ represents treating partially bleached pulp with second xylanase in a second enzyme treatment stage, B represents any chemical bleaching stage, D represents a chlorine dioxide bleaching stage, O represents an alkaline oxygen delignification stage and E represents an alkaline extraction stage. Preferably each O, B, D and E stage comprises a water wash as a final step of the stage. More preferably, each O, B, D, E, $X_1$, and $X_2$ stage comprises a water wash as a final step of the stage. Further, a pulp bleaching sequence comprising two or more stages denoted by the same character may be performed under identical or dissimilar conditions. For example, but not wishing to be limiting, a pulp bleaching sequence comprising three D stages may comprise identical or different treatment conditions in each stage.

In another embodiment of the present invention, there is provided a method of bleaching chemical pulp in the absence of a peroxyacid, the method comprising the steps of:

a) exposing the chemical pulp to a first chlorine dioxide bleaching stage to produce a partially bleached pulp;

b) treating the partially bleached pulp with a xylanase in an enzyme treatment stage at a pH of about 3 to about 8 to produce an enzymatically treated pulp;

c) extracting the enzymatically treated pulp in an alkaline extraction stage to produce an extracted pulp, and;

d) exposing the extracted pulp to a second chlorine dioxide bleaching stage.

The alkaline extraction stage in the step of extracting (step c),) and the second chlorine dioxide stage in step d) are carried out using procedures familiar to those skilled in the art, for example Dence and Reeve (1996, Pulp Bleaching: Principles and Practice, Dence and Reeve, eds., which is herein incorporated by reference) describes these stages in detail. The pulp bleaching method of the present invention enhances pulp bleaching compared to conventional pulp bleaching processes known in the art. Further, the pulp bleaching method of the present invention is easily integrated into pulp bleaching processes which are currently practised in the art.

Representative pulp bleaching sequences contemplated by the present invention are described in FIG. 1B. The pulp bleaching sequences are for illustrative purposes only and are not meant to limit the invention in any manner. The method of the present invention contemplates pulp bleaching sequences comprising a xylanase treatment stage following a chlorine dioxide bleaching stage (Do-X) such as, but not limited to:

Do-E-X,
Do-X-E,
Do-X-E-B,
Do-X-E-D,
O-Do-X-E-D,
Do-X-E-D-E-D,
O-Do-X-E-D-E,
O-Do-X-E-D-E-D, and
O-Do-X-E-D-X-E-D, wherein, Do represents a chlorine dioxide bleaching stage, and the other stages are as defined above. Further, a pulp bleaching sequence comprising two or more stages denoted by the same character may be performed under identical or dissimilar conditions. For example, but not wishing to be limiting, a pulp bleaching sequence comprising three D stages may comprise identical or different treatment conditions in each stage. It is also contemplated that an alkaline extraction stage may be present in the method of the present invention, such as, but not limited to:

Do-X-E-D-E-D and
Do-X-E-D-X-E-D.

It is preferred that the chlorine dioxide bleaching stage comprises a water wash as a final step of the stage prior to the step of treating the partially bleached pulp with a xylanase. More preferably, the enzyme treatment stage, and the chlorine dioxide bleaching stage comprise a water wash as a final step of each stage. Further, the pulp bleaching method may be performed in a mill as part of a complex pulp bleaching process.

In a preferred embodiment, the chlorine dioxide bleaching stage is performed at a pH in the range of about 1 to about 5, preferably about 1.5 to about 3. Further, any xylanase which is capable of hydrolyzing the xylan and enhancing the bleaching of pulp may be used in the method of the present invention provided that the xylanase is active under the conditions of an enzyme treatment stage at pH about 3 to less than 8. In a preferred embodiment the xylanase is the BIOBRITE EB xylanase which is commercially available from logen Corporation and the conditions of the enzyme treatment stage are adjusted such that oxygen delignified chemical pulp is adjusted to between about 5% and about 10% consistency and incubated at a temperature between about 50° C. and about 63° C., a pH of about 6 to about 7.5, for a period of about 15 minutes to about 60 minutes with an amount of enzyme between about 0.5 and about 1.0 unit of xylanase activity per gram of pulp. However, other conditions are also effective for xylanase activity and may enhance bleaching of pulp in the method of the present invention.

Referring now to FIG. 2, there are compared four different pulp bleaching sequences on the brightness of hardwood pulp after a $D_1$ bleaching stage based on a desired $Do+D_1$ pulp kappa factor between 0.25 and 0.40. The bleaching sequences are performed as described in the Examples 4 and 5. As shown in FIG. 2, a pulp bleaching sequence that comprises treating pulp with a xylanase in an enzyme treatment stage after chlorine dioxide bleaching ($DoXEoD_1$ (□)) is more effective at bleaching pulp than a pulp bleaching sequence which comprises treating pulp with the same xylanase in an identical enzyme treatment stage prior to chlorine dioxide bleaching (XDoEoD1 (◇)). Further, a pulp bleaching sequence comprising $DoXEoD_1$ (□) is more effective at bleaching pulp than a pulp bleaching sequence DoEoD1 which comprises no xylanase treatment stage $DoEoD_1$ (○).

Also shown in FIG. 2, a pulp bleaching sequence comprising a first enzyme treatment stage with a first xylanase followed by a chlorine dioxide bleaching stage and then followed by a second enzyme treatment stage with a second xylanase ($X_1DoX_2EoD_1$ (Δ)) is more effective at bleaching pulp than a pulp bleaching sequence comprising a first enzyme treatment stage with a xylanase prior to chlorine dioxide bleaching ($XDoEoD_1$ (◇)). Further, a pulp bleaching sequence comprising $X_1DoX_2EoD_1$ (Δ) is more effective than a pulp bleaching sequence which comprises no xylanase treatment stages $DoEoD_1$ (○).

Also shown by FIG. 2, is that a pulp bleaching sequence comprising $X_1DoX_2EoD_1$ (◇), is more effective than a pulp bleaching sequence comprising $XDoEoD_1$ (◇), even when the amount of xylanase enzyme used in each enzyme treatment stage of the $X_1DoX_2EoD_1$ (Δ) pulp bleaching process is less than half of that used in the enzyme treatment stage of the $XDoEoD_1$ (◇) pulp bleaching process.

Figure 3:
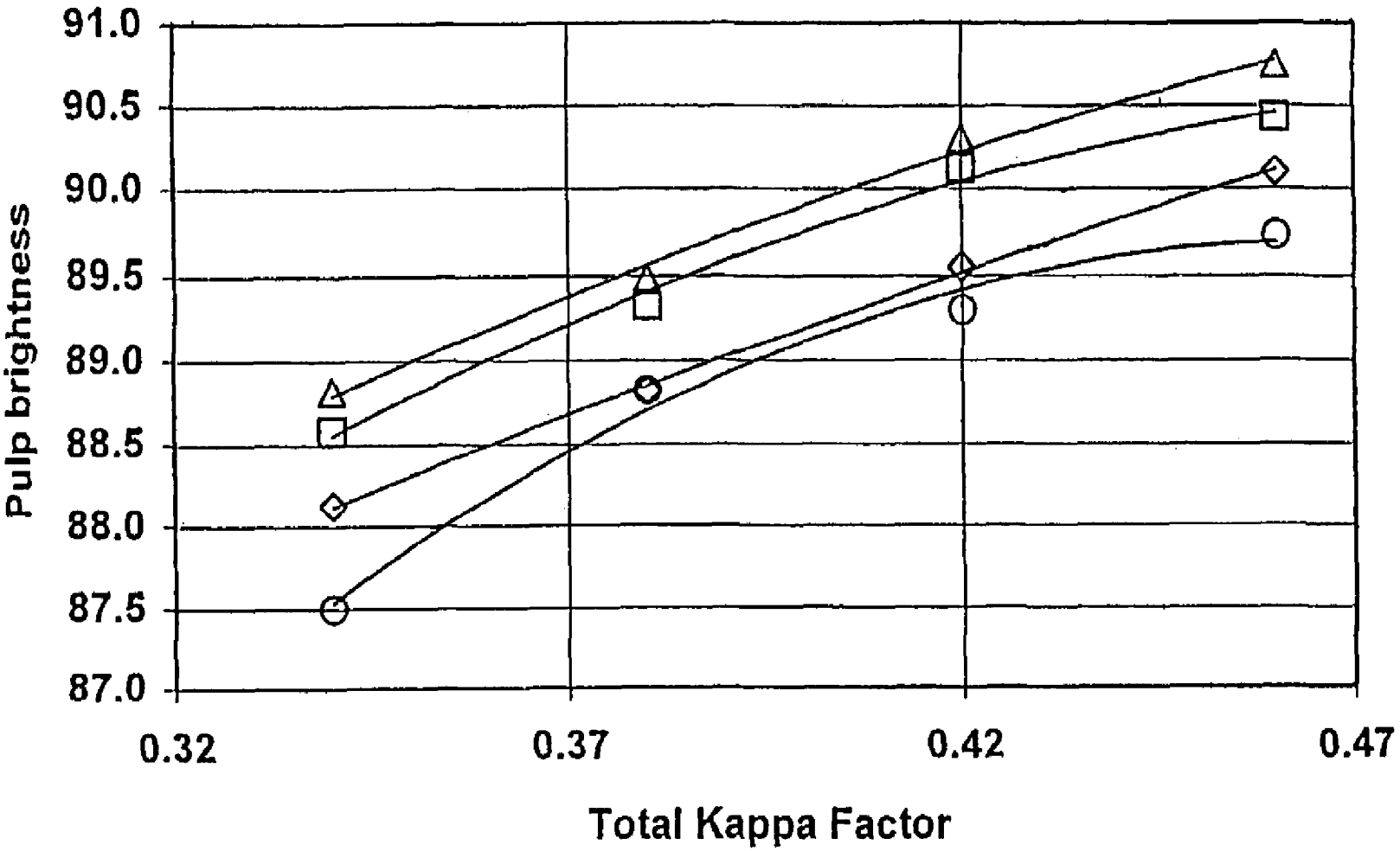
FIG. 3 shows the effect of 3 types of xylanase treatment on softwood pulp brightness relative to a control pulp not treated with xylanase (DoEoDED; ○); xylanase treatment prior to chemical bleaching (XDoEoDED; ◇); xylanase treatment after chemical bleaching (DoXEoDED; □); and xylanase treatment prior to and after chemical bleaching ($X_1DOX_2EoDED$; Δ).

Referring now to FIG. 3, there is compared four different pulp bleaching sequences on the brightness of softwood pulp after bleaching based on a pulp total kappa factor between 0.32 and 0.47. As shown in FIG. 3, a pulp bleaching sequence that comprises treating pulp with a xylanase in an enzyme treatment stage after chlorine dioxide bleaching (DoXEoDED (◇)) is more effective at bleaching pulp than a pulp bleaching sequence which comprises treating pulp with the same xylanase in an identical enzyme treatment stage prior to chlorine dioxide bleaching (XDoEoDED (◇)). FIG. 3 also shows that a pulp bleaching sequence comprising DoXEoDED (□) is more effective at bleaching pulp than a pulp bleaching sequence DoEoDED which comprises no xylanase treatment stage (DoEoDED;○).

Also shown in FIG. 3, a pulp bleaching sequence comprising a first enzyme treatment stage with a first xylanase followed by a chlorine dioxide bleaching stage and then followed by a second enzyme treatment stage with a second xylanase ($X_1DoX_2EoDED$ (Δ)) is more effective at bleaching softwood pulp than a pulp bleaching sequence comprising a first enzyme treatment stage with a xylanase prior to chlorine dioxide bleaching (XDoEoDED (◇)). Further, a pulp bleaching sequence comprising $X_1DoX_2EoDED$ (Δ) is more effective than a pulp bleaching sequence that comprises only chlorine dioxide bleaching. Also, a pulp bleaching sequence comprising $X_1DoX_2EoDED$ (Δ) is more effective than a pulp bleaching sequence comprising XDoEoDED (◇) even when the amount of xylanase enzyme used in each enzyme treatment stage of the $X_1DoX_2EoDED$ (Δ) pulp bleaching process is half that used in the enzyme treatment stage of the XDoEoDED (◇) pulp bleaching process. The data in FIG. 3 suggest that more efficient pulp bleaching may be obtained by performing a DoXEoDED pulp bleaching sequence or a $X_1DoX_2EoDED$ pulp bleaching sequence where the total enzyme dose is divided between both enzyme treatment stages rather than performing a single enzyme treatment stage prior to chlorine dioxide bleaching.

The data in FIGS. 2 and 3 suggest that more efficient pulp bleaching may be obtained by performing a DoX pulp bleaching sequence or a $X_1BX_2$ (or $X_1DoX_2$) pulp bleaching sequence wherein the total enzyme dose is divided between both enzyme treatment stages rather than performing a single enzyme treatment stage prior to chlorine dioxide bleaching (XDo). Further, dual xylanase treatment stages wherein a first xylanase treatment stage is performed prior to chemical bleaching and a second xylanase treatment stage is performed after chemical bleaching may provide a synergistic effect to enhance pulp bleaching. Thus, a pulp bleaching process comprising DoX, $X_1BX_2$, or $X_1DoX_2$ may require less enzyme to bleach pulp than other pulp bleaching processes which perform a single xylanase treatment stage prior to chlorine dioxide bleaching. This could provide significant cost savings to mills. Alternatively, per unit of enzyme used in a mill, a pulp bleaching process comprising DoX, $X_1BX_2$, or $X_1DoX_2$ may reduce the amount of chlorine dioxide which must be used in subsequent bleaching stages to produce pulp of a desired brightness. This also provides savings in the cost of bleaching chemicals and reduces the amount of chlorinated waste effluent produced by pulp bleaching.

The data of FIGS. 2 and 3 also suggest that a pulp bleaching process comprising $X_1D_oX_2$ may be more efficient at bleaching pulp than a pulp bleaching process comprising DoX for bleached hardwood and softwood pulp samples. Under some conditions, a pulp bleaching process comprising DoX may be more efficient at bleaching pulp than a pulp bleaching process comprising $X_1DoX_2$. However, in all of the tests performed, pulp bleaching sequences comprising DoX and $X_1DoX_2$ are more efficient at bleaching pulp than equivalent pulp bleaching processes comprising the XDo bleaching sequence. In addition, pulp bleaching sequences such as $X_1BX_2$, wherein chemical bleaching is performed with bleaching agents other than chlorine dioxide, also exhibited more efficient pulp bleaching than similar pulp bleaching sequences which employ a xylanase treatment stage prior to chemical bleaching (XB) (data not shown). Thus, the present invention contemplates pulp bleaching sequences comprising:

$X_1DoX_2$, $X_1BX_2$ and

DoX for all types of chemical pulps. Further, the $X_1DoX_2$, $X_1BX_2$ and DoX pulp bleaching sequences may be practiced in a mill, as part of a more complex pulp bleaching sequence.

The results depicted for the $X_1DoX_2$ bleaching sequences in FIGS. 2 and 3 employ the same xylanase in the $X_1$ and $X_2$ enzyme treatment stages and both the $X_1$ and $X_2$ stages are performed under identical conditions. However, different xylanases used under different conditions in the $X_1$ and $X_2$ enzyme treatment stages also produced similar results to those shown in FIGS. 2 and 3. Similarly, using identical xylanases in the $X_1$ and $X_2$ enzyme treatment stages, but under different conditions also produced results which are similar to those shown in FIGS. 2 and 3.

Figure 4:
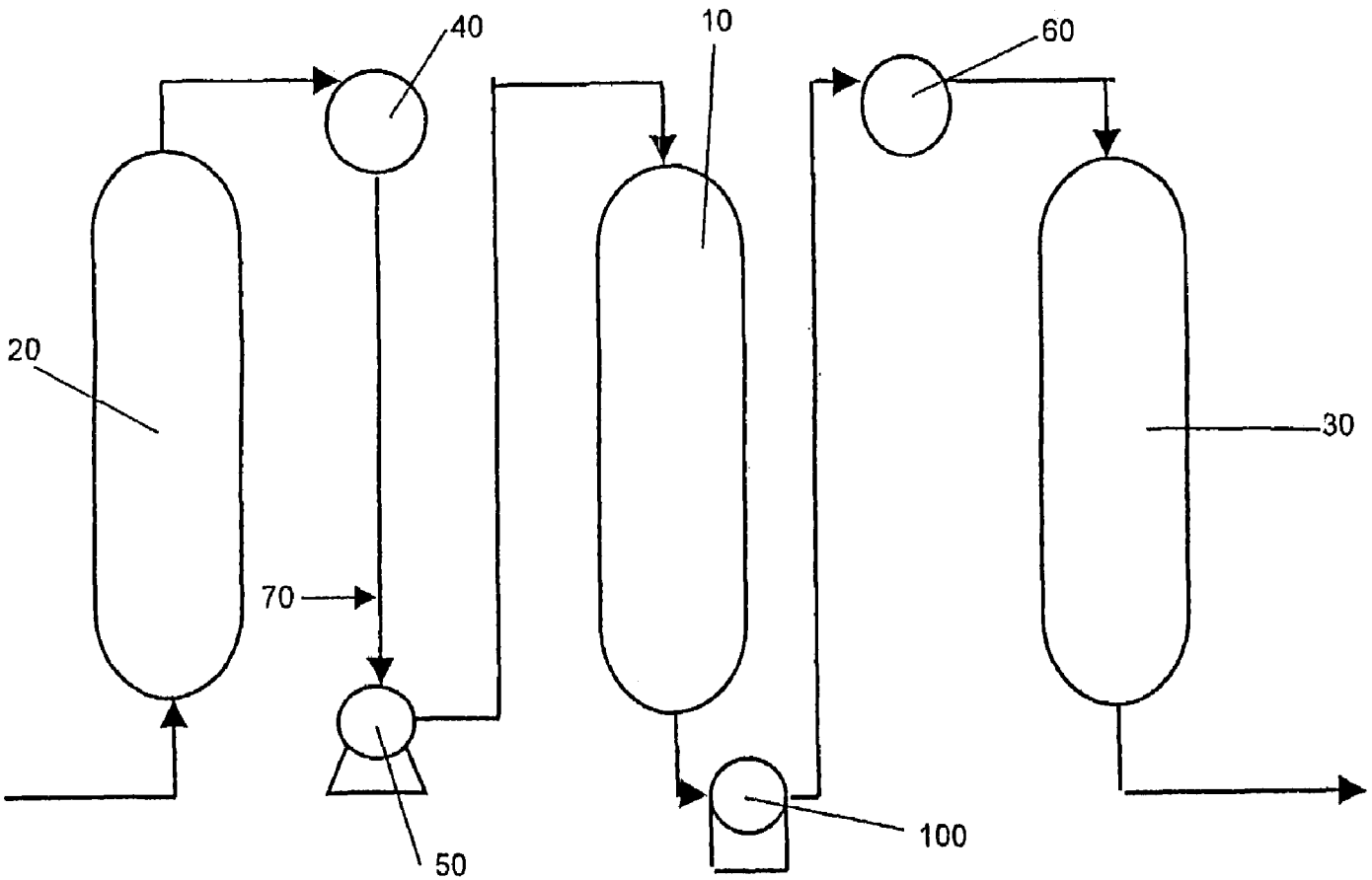
FIG. 4 shows a diagram depicting an aspect of an embodiment of a pulp bleaching process wherein a Papricycle™ tower is integrated between a chemical bleaching stage and an alkaline extraction stage.

As would be evident to someone of skill in the art, it is preferred that each enzyme treatment stage be carried out in an appropriate vessel. For xylanase treatment of pulp after the Do stage, it is preferred that a suitable vessel such as, but not limited to a Papricycle™ tower be integrated into a bleach plant. Shown in FIG. 4 is a portion of a bleach plant wherein a Papricycle™ tower (10) has been integrated between the first chlorine dioxide tower (20) and the first extraction tower (30). Chlorine dioxide treated pulp coming from tower (20) is washed in a first washer (40) and then transferred through pump (50) to Papricycle™ tower (10) for xylanase treatment. Xylanase may be added to pulp from feed line (70) prior to entering pump (50). After an appropriate incubation period in the Papricycle™ tower (10), the pulp is transferred by pump (100) to washer (60) where the pulp is washed. After the wash by washer (60) the pulp is transferred into an alkaline extraction tower (30). As would be evident to someone of skill in the art, FIG. 4 includes one or more sites for adjusting the pH of the pulp. Preferably, the pulp is not subjected to harsh chemicals for pH adjustment at the site where xylanase is added.

As would be readily apparent to someone of skill in the art, there exists other ways of integrating one or more enzyme treatment stages into a pulp bleaching process. One or more enzyme treatment stages may be integrated in a batch pulp feed process, as suggested by FIG. 4 or alternatively, one or more enzyme treatment stages may be integrated into a continuous flow pulping process. The method of the present invention contemplates enzyme treatment stages in both batch and continuous flow pulping processes.

The method of the present invention comprises treating partially bleached pulp with a xylanase in an enzyme treatment stage at an initial pH in the range from about 3 to about 8. As is evident to someone of skill in the art, the pH of an enzyme treatment stage tends to drift upward 0.5 to 1.5 units during treatment. Thus, the method of the present invention also contemplates enzyme treatment stages that reach a final pH of about 3 to about 8 and which start at a pH outside this range.

The above description is not intended to limit the claimed invention in any manner. Furthermore, the discussed combination of features might not be absolutely necessary for the inventive solution.

All references are herein incorporated by reference.

The present invention will be further illustrated in the following examples. However, it is to be understood that these examples are for illustrative purposes only, and should not be used to limit the scope of the present invention in any manner.

EXAMPLE 1

Determination of Kappa Number

The kappa number of the pulp is determined using the protocol described in: TAPPI method for Kappa number of pulp (T 236 cm-85) from TAPPI Test Methods 1996-1997, which is herein incorporated by reference. Briefly, the kappa number is the volume (in milliliters) of a 0.1 N potassium permanganate solution consumed by one gram of moisture-free pulp under the conditions specified in the method. The results are corrected to 50% consumption of the permanganate added.

The kappa number determination is performed at a constant temperature of 25° C.±0.2° C. with continuous agitation. However, it is possible to correct for variations in temperature as is described below.

The moisture content of the pulp is determined in accordance with TAPPI T 210 "Sampling and Testing Wood Pulp Shipments for Moisture" which is herein incorporated by reference. Briefly, the pulp specimen is disintegrated in about 800 mL of distilled water and stirred. 100 mL of 0.1 N potassium permanganate and 100 mL of 4N sulfuric acid (bringing the total volume to about 1 L) are added to the slurry and allowed to react for 10 minutes. At the end of the 10 minute period, the reaction is stopped by adding 20 mL of 1.0 N potassium iodide and the solution is titrated with 0.2 N sodium thiosulfate.

The kappa number of the pulp may be calculated using the following formula:

$$K=(p\times f)/w$$

wherein:

$$p=(b-a)N/0.1;$$

And wherein;

K is the kappa number;

f is the factor for correction to a 50% permanganate consumption, depending on the value of p($f=w*10^{(0.00093\times(p-50))}$);

w is the weight in grams of moisture-free pulp in the specimen;

p is the amount of 0.1 N potassium permanganate solution consumed by the test specimen in mL;

b is the amount of the thiosulfate solution consumed in a blank determination in mL;

a is the amount of thiosulfate solution consumed by the test specimen in mL; and N=normality of the thiosulfate solution.

Correction of the kappa number of the pulp for determinations made at temperatures between 20° C. and 30° C. may be made using the formula:

$$K=p\times f(1+0.013(25-t))/w$$

wherein:

t is the actual reaction temperature in degrees Celsius.

EXAMPLE 2

Standard Assay for the Measurement of Xylanase Activity

Xylanase Assay #1:

The endo xylanase assay is specific for endo-1,4-beta-D-xylanase activity. On incubation of azo-xylan (oat) with xylanase, the substrate is depolymerized to produce low-molecular weight dyed fragments which remain in solution on addition of ethanol to the reaction mixture. High molecular weight material is removed by centrifugation, and the colour of the supernatant is measured. Xylanase activity in the assay solution is determined by reference to a standard curve.

Substrate: The substrate is purified (to remove starch and beta-glucan). The polysaccharide is dyed with Remazolbrilliant Blue R to an extent of about one dye molecule per 30 sugar residues. The powdered substrate is dissolved in water and sodium acetate buffer and the pH is adjusted to 4.5.

Assay: Xylanase is diluted in 0.5M acetate buffer at pH 4.5. Two milliliters of the solution is heated at 40° C. for 5 minutes. 0.25 mL of pre-heated azo-xylan is added to the enzyme solution. The mixture is incubated for 10 minutes. The reaction is terminated and high molecular weight substrate is precipitated by adding 1.0 mL of ethanol (95% v/v) with vigorous stirring for 10 seconds on a vortex mixer. The reaction tubes are allowed to equilibrate to room temperature for 10 minutes and are then centrifuged at 2000 rpm for 6-10 minutes. The supernatant solution is transferred to a spectrophotometer cuvette and the absorbance of blank and reaction solutions measured at 590 nm. Activity is determined by reference to a standard curve. Blanks are prepared by adding ethanol to the substrate before the addition of enzyme.

The following assay may also be used to quantify xylanase activity.

Xylanase Assay #2: The quantitative assay determines the number of reducing sugar ends generated from soluble xylan. The substrate for this assay is the fraction of birchwood xylan which dissolves in water from a 5% suspension of birchwood xylan (Sigma Chemical Co.). After removing the insoluble fraction, the supernatant is freeze dried and stored in a dessicator. The measurement of specific activity is performed as follows: Reaction mixtures containing 100 μL of 30 mg/mL xylan previously diluted in assay buffer (50 mM sodium citrate, pH 5.5 or the pH optimum of the tested xylanase), 150 μL assay buffer, and 50 μL of enzyme diluted in assay buffer were incubated at 40° C. (or the temperature optimum of the tested xylanase). At various time intervals 50 μL portions are removed and the reaction is stopped by diluting in 1 mL of 5 mM NaOH. The amount of reducing sugars is determined using the hydroxybenzoic acid hydrazide reagent (HBAH) (Lever, 1972, Analytical Biochem 47:273-279). A unit of enzyme activity is defined as that amount generating 1 μmol reducing sugar in 1 minute at 40° C. (or at the optimum pH and temperature of the enzyme).

EXAMPLE 3

Preparation of Chlorine Dioxide

Chlorine dioxide was made in the lab by the standard procedure of passing a mixture of chlorine gas and nitrogen through a series of columns containing sodium chlorite, and collecting the evolved gas in cold water. The chlorine dioxide was stored refrigerated at a concentration of 10.4 grams per liter in water. Further details regarding the preparation of chlorine dioxide may be found in Chlorine Dioxide Generation published by Paprican, Pointe Claire, Quebec (which is herein incorporated by reference).

EXAMPLE 4

Xylanase Treatment of Pulp

A 15 g unbleached hardwood pulp sample having a predetermined kappa number is adjusted to a consistency of 10% (wt/vol) with deionized water and the pH of the pulp is adjusted between 6.8 and 7 with a 10% solution of $Na_2CO_3$. The pulp sample is heated to 57° C. prior to adding Biebrite BIOBRITE EB xylanase, which is commercially available from Iogen Corporation. Enzyme is added to samples and the pulp samples are incubated at 57° C. for 60 minutes. Following the incubation period the reaction is stopped by lowering the pH to between 2.5 and 3 by the addition of hydrochloric acid and by cooling the samples in an ice water bath.

The enzyme dose is 0.58 units of xylanase activity (measured according to the first xylanase assay described in Example 2) per gram of pulp for pulp bleaching sequences comprising XDo, wherein xylanase treatment occurs prior to the first chlorine dioxide bleaching stage (XDo). The enzyme dose is 0.54 units per gram of pulp for pulp bleaching sequences comprising DoX, wherein xylanase treatment occurs after the first chlorine dioxide bleaching stage, and the enzyme dosage is 0.22 xylanase units per gram of pulp in each treatment stage for pulp bleaching sequences comprising $X_1DoX_2$, wherein xylanase treatment is performed prior to and after the first chlorine dioxide bleaching stage.

For comparative purposes, DoX, XDo, and $X_1DoX_2$ pulp samples may be mock-treated under conditions which lack xylanase to facilitate comparison of the different bleaching processes. For example, all the pulp bleaching processes may be more effectively compared using the following treatments:

$TDoWEoD_1ED_2$
$XDoWEoD_1ED_2$
$TDoXEoD_1ED_2$
$XDoXEoD_1ED_2$ wherein T and W represent equivalent conditions to the xylanse treatment stage X, except that no xylanase is used in the T and W stages.

EXAMPLE 5

Chlorine Dioxide Bleaching of Hardwood Pulp samples

Pulp samples are subjected to chlorine dioxide bleaching stages which are similar to those described in Glossary of Bleaching Terms CPPA technical section, which is herein incorporated by reference, describing optimum conditions of 1.0%-2.3% $ClO_2$ on pulp, 40-60° C., 3-10% pulp consistency, 30-60 minute incubation period, pH 2.5 to 3.0.

Chlorine Dioxide Bleaching (Do) Stage

The first chlorine dioxide bleaching stage is the Do stage. $ClO_2$ is added to the pulp and the system is maintained in a heat-sealable plastic bag. The pulp mixture is cooled to 4° C. to minimize evaporation. Pulp kappa factors of 0.15, 0.17, 0.19 and 0.21 are used to calculate the chlorine dioxide charge required in the bleaching stage. The chlorine dioxide charge may be estimated using the following formulas: kappa factor=equivalent chlorine (kg/ton pulp)/kappa number×10 chlorine dioxide charge (kg/ton pulp)=10×kappa factor×kappa number/2.63

Based on a kappa factor of 0.17 and a pulp kappa number of 13.9, the corresponding chlorine dioxide usage is 9 kg/ton pulp. After $ClO_2$ addition, the pulp comprises 4% consistency, pH 2.5 to 3.0 and the bags are placed in a 50° C. water bath for 60 minutes. Following the incubation period, pulp samples are washed with 2 L of tap water. Subsequently, DoX and $X_1DOX_2$ pulp samples are treated with xylanase according to Example 4.

Alkaline Extraction Stage (Eo)

After the first chlorine dioxide bleaching stage (Do), the pulp samples are subjected to an alkaline extraction stage (Eo). For DoX and $X_1DoX_2$ treated pulps, the Eo stage is performed after the Do stage and after a xylanase treatment stage. The Eo stage comprises incubating pulp samples at 75° C., 10% (wt/vol) consistency, with a sodium hydroxide charge of 1.7% (wt/wt) in the presence of 15 psig oxygen, for 60 minutes. The pH of the extraction medium is about 11.5 at the end of the incubation. Following the incubation period, each pulp sample is washed with 2 L of tap water.

Chlorine Dioxide Bleaching ($D_1$) Stage

The $D_1$ stage is performed in a similar manner to the Do stage. Briefly, pulp samples are adjusted to a consistency of 10% (wt/vol) and incubated at pH 3.6 to about 4, 75° C. for 180 minutes. The chlorine dioxide charge for pulp with kappa factors of 0.11, 0.13, 0.15 and 0.17 are 0.64%, 0.75%, 0.87% and 0.98% (w/w) respectively. Following the incubation period, each pulp sample is washed with 2 L of tap water.

Following the D1 stage the brightness of the pulp may be measured according to Example 7. This is the $D_1$ brightness of the pulp. The pulp may be bleached further by performing a second extraction stage, and a third chlorine dioxide bleaching stage.

Extraction Stage (E)

Following the $D_1$ stage the pulp is subjected to an extraction stage. The extraction stage comprises incubating pulp at 75° C. for 90 minutes with a 1% NaOH charge. The pulp consistency is 10% (wt/vol) and the pH of the pulp following the incubation period is about 11.3. Following the extraction stage, each pulp sample is washed with 2 L of tap water.

Chlorine Dioxide Bleaching ($D_2$)Stage

The $D_2$ stage is performed in a similar manner to the other chlorine dioxide bleaching stages. The pulp samples are adjusted to a consistency of 10% (wt/vol). The chlorine dioxide charge is 0.29% (w/w) for each sample. Samples are incubated at 75° C. for a period of 180 minutes. The final pH of the chlorine dioxide bleaching stage is about pH 4.

Following the Chlorine Dioxide Bleaching ($D_2$) stage, the brightness of the pulp may be measured according to Example 7. This is the $D_2$ brightness of the pulp.

Using the above method, the effects of four different pulp bleaching sequences (as described in Examples 4 and 5) on the brightness of hardwood pulp after a $D_1$ bleaching stage, and based on a desired $D_1$ pulp kappa factor between 0.25 and 0.40 were examined. The results are presented in FIG. 2.

The results of FIG. 2 show that:

i) $DoXEoD_1$ (□) and $X_1DoX_2EoD_1$(Δ) are more effective at bleaching pulp than a bleaching sequence comprising chlorine dioxide bleaching stages with no xylanase treatment stage;

ii) $DoXEoD_1$ (□) and $X_1DoX_2EoD_1$ (Δ) are more effective at bleaching pulp than a bleaching sequence which comprises treating pulp with the same xylanase in an enzyme treatment stage prior to chlorine dioxide bleaching ($XDoEoD_1$ (◇));

iii) $X_1DoX_2EoD_1$ (Δ) is more effective than a pulp sequence comprising $XDoEoD_1$ (◇); the amount of xylanase enzyme used in each enzyme treatment stage of the $X_1DoX_2$ $EoD_1$ (Δ) pulp bleaching process is less than half of that used in the enzyme treatment stage of the $XDoEoD_1$ (Δ) pulp bleaching process; see Example 4.

These results demonstrate that bleaching of hardwood pulp may be improved by using a pulp bleaching sequence incorporating a xylanase treatment stage after a chemical bleaching stage. Furthermore, a xylanase treatment stage may be effectively used after a chemical bleaching stage, and before an extraction stage.

EXAMPLE 6

Chlorine Dioxide Bleaching of Softwood Pulp Samples

Pulp samples are subjected to chlorine dioxide bleaching stages which are similar to those described in Glossary of Bleaching Terms CPPA technical section, which is herein incorporated by reference.

Chlorine Dioxide Bleaching (Do) Stage

The first chlorine dioxide bleaching stage is the Do stage. $ClO_2$ is added to the pulp and the system is maintained in a heat-sealable plastic bag. The pulp mixture is cooled to 4° C. to minimize evaporation. Pulp kappa factors of 0.17, 0.19, 0.21 and 0.23 are used to calculate the chlorine dioxide charge required in the bleaching stage. The chlorine dioxide charge may be estimated using the formulas described in Example 5.

After $ClO_2$ addition, the pulp comprises 4% consistency, pH 2.5 to 3.0 and the bags are placed in a 50° C. water bath for 60 minutes. Following the incubation period, pulp samples are washed with 2 L of tap water. Subsequently, DoX and $X_1DOX_2$ pulp samples are treated with xylanase according to Example 4.

Alkaline Extraction Stage (Eo)

After the first chlorine dioxide bleaching stage (Do), the pulp samples are subjected to an alkaline extraction stage (Eo). For DoX and $X_1DoX_2$ treated pulps, the Eo stage is performed after the Do stage and after the xylanase treatment stage. The Eo stage comprises incubating pulp samples at 75° C., 10% (wt/vol) consistency, with a sodium hydroxide charge of 1.5% (wt/wt) in the presence of 15 psig oxygen, for 60 minutes. The pH of the extraction medium is about 11 at the end of the incubation. Following the incubation period, each pulp sample is washed with 2 L of tap water.

Chlorine Dioxide Bleaching ($D_1$) Stage

The $D_1$ stage is performed in a similar manner to the Do stage. Briefly, pulp samples are adjusted to a consistency of 10% and incubated at pH 3.1 to about 4, 75° C. for 150 minutes. The chlorine dioxide charge for pulp with kappa factors of 0.11, 0.13, 0.15 and 0.17 are 0.79%, 0.94%, 1.08% and 1.22% (w/w) respectively. Following the incubation period, each pulp sample is washed with 2 L of tap water.

Following the $D_1$ stage, the brightness of the pulp may be measured according to Example 7. This is the $D_1$ brightness of the pulp.

Extraction Stage

Following the $D_1$ stage the pulp is subjected to an extraction stage. The extraction stage comprises incubating pulp at 75° C. for 60 minutes with a 1% NaOH charge. The pulp consistency is 10% and the pH of the pulp following the incubation period is about 11.3. Following the extraction stage, each pulp sample is washed with 2 L of tap water.

The pulp may be further bleached by performing a second extraction stage and a third chlorine dioxide bleaching stage.

Chlorine Dioxide Bleaching ($D_2$) stage

The $D_2$ stage is performed in a similar manner to the other chlorine dioxide bleaching stages. The pulp samples are adjusted to a consistency of 10% (wt/vol). The chlorine dioxide charge is 0.43% for each sample. Samples are incubated at 75° C. for a period of 150 minutes. The final pH of the chlorine dioxide bleaching stage is about pH 4.

Following the Chlorine Dioxide Bleaching ($D_2$) stage, the brightness of the pulp may be measured according to Example 7. This is the $D_2$ brightness of the pulp.

Using the above method, the effect of four different pulp bleaching sequences (as defined in Examples 4 and 5) on the brightness of softwood pulp after a $D_2$ bleaching stage based on a desired Total pulp kappa factor between 0.32 and 0.47 is examined. The results of this experiment are presented in FIG. 3.

The results of FIG. 3 show that:

i) DoXEoDED (□), and $X_1DoX_2EoDED$ (Δ) are more effective at bleaching pulp than a bleaching sequence comprising chlorine dioxide bleaching stages with no xylanase treatment stage, such as DoEoDED (○);

ii) DoXEoDED (□), and $X_1DoX_2EoDED$ (Δ) are more effective at bleaching pulp than a bleaching sequence which comprises treating pulp with the same xylanase in an enzyme treatment stage prior to chlorine dioxide bleaching (XDoEoDED (◇) ;

iii) $X_1DoX_2EoDED$ (Δ) is more effective than a bleaching sequence comprising XDoEoDED (◇); the amount of xylanase enzyme used in each enzyme treatment stage of the $X_1DoX_2EoDED$ bleaching sequence is less than half of that used in the enzyme treatment stage of the XDoEoDED bleaching sequence; see Example 4.

These results demonstrate that bleaching of softwood pulp may be improved by using a pulp bleaching sequence incorporating a xylanase treatment stage after a chemical bleaching stage. Furthermore, a xylanase treatment stage may be effectively used after a chemical bleaching stage, and before an extraction stage.

EXAMPLE 7

Measuring Pulp Brightness

Pulp brightness is measured according to the method disclosed by PAPTAC-Standard Testing Methods July, 1997 (Standard El brightness of Pulp, Paper and Paperboard) which is herein incorporated by reference. Briefly, a 3.75 g sample of oxygen delignified pulp is used to form a brightness pad. A pulp sample is placed in a 500 mL container and water is added to about 200 mL. About 2 mL of sulfuric acid solution is added to each jar and the contents mixed well. A pad is formed pouring the pulp into a funnel under vacuum and subsequently pressing the pad with a plunger. Each pad is pressed between blotters using a hydraulic press. The pulp pad is allowed to dry overnight at room temperature.

ISO Brightness Determination

Brightness is measured using an Elrephometer. The sample is diffusely illuminated using a highly reflecting, integrated sphere. Reflected light is measured at right angles to the sample. Reflectance is compared to absolute reflectance based on a perfectly reflecting, perfectly diffusing surface which is considered to exhibit a brightness of 100%. Magnesium oxide is one standard which is used to compare to pulp brightness. A blue light of wavelength 457 nm is used for the brightness reading.

All references are herein incorporated by reference.

The present invention has been described with regard to preferred embodiments. However, it will be obvious to persons skilled in the art that a number of variations and modifications can be made without departing from the scope of the invention as described herein.

REFERENCES

Ericksson, K. E. L., (1990) Wood Science and Technology 24; 79-101.

Lüthi, E., Jasmat, N. B., and Bergquist, P. L. (1990) Appl. Environ. Microbiol. 56:2677-2683.

Paice, M. G., R. Bernier, and L. Jurasek, (1988) Biotechnol. and Bioeng. 32, 235-239.

Pommier, J. C., J. L. Fuentes, and G. Goma, (1989) Tappi Journal, 187-191.

Reeve and Dence (1996) Pulp Bleaching Principles and Practice. Tappi Press, Atlanta, Ga.

Simpson, H. D., Haufler, U. R., and Daniel, R. M. (1991) Biochem. J. (1991) 277:413-417.

Winterhalter C. and Liebl, W. (1995) Appl. Environ. Microbiol. 61:1810-1815.

The invention claimed is:

1. A method of bleaching chemical pulp in the absence of a peroxyacid, said method comprising the steps of a) exposing said chemical pulp to a first chlorine dioxide bleaching stage (D-Stage) to produce a partially bleached pulp;

b) treating said partially bleached pulp with a xylanase in an enzyme treatment stage at a pH of about 3 to about 8 to produce an enzymatically treated pulp;

c) extracting said enzymatically treated pulp in an alkaline extraction stage to produce an extracted pulp; and d) re-exposing said extracted pulp to a second bleaching stage.

2. The method of claim 1, wherein in said step of re-exposing, (step d)), said second bleaching stage is a second chlorine dioxide bleaching stage.

3. The method of claim 2, wherein pulp exiting said second chlorine dioxide bleaching stage is exposed to an alkaline extraction stage followed by a chlorine dioxide bleaching stage.

* * * * *